US008276515B1

(12) United States Patent
Robinson et al.

(10) Patent No.: US 8,276,515 B1
(45) Date of Patent: Oct. 2, 2012

(54) ULTRA-MINIATURE ELECTRO-MECHANICAL SAFETY AND ARMING DEVICE

(75) Inventors: Charles H. Robinson, Potomac, MD (US); Robert H. Wood, Laurel, MD (US); Mark R. Gelak, Columbia, MD (US); Thinh Q. Hoang, Beltsville, MD (US); Gabriel L. Smith, Odenton, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 424 days.

(21) Appl. No.: 12/434,093

(22) Filed: May 1, 2009

Related U.S. Application Data

(60) Provisional application No. 61/049,585, filed on May 1, 2008.

(51) Int. Cl.
*F42C 15/26* (2006.01)
*F42C 15/196* (2006.01)

(52) U.S. Cl. ..... 102/231

(58) Field of Classification Search ..... 102/221, 102/231, 235, 251, 233, 237, 245, 249; 361/248, 361/249, 250
See application file for complete search history.

(56) References Cited

U.S. PATENT DOCUMENTS

| | | | | |
|---|---|---|---|---|
| 6,167,809 | B1 * | 1/2001 | Robinson et al. | 102/235 |
| 6,314,887 | B1 * | 11/2001 | Robinson | 102/262 |
| 6,321,654 | B1 * | 11/2001 | Robinson | 102/251 |
| 6,568,329 | B1 * | 5/2003 | Robinson | 102/231 |
| 6,964,231 | B1 * | 11/2005 | Robinson et al. | 102/235 |
| 7,055,437 | B1 * | 6/2006 | Robinson et al. | 102/222 |
| 7,069,861 | B1 * | 7/2006 | Robinson et al. | 102/222 |
| 7,530,312 | B1 * | 5/2009 | Roesler et al. | 102/249 |
| 7,552,681 | B1 * | 6/2009 | Laib et al. | 102/254 |
| 7,913,623 | B1 * | 3/2011 | Fan et al. | 102/254 |

* cited by examiner

*Primary Examiner* — James Bergin
(74) *Attorney, Agent, or Firm* — Henry S. Goldfine

(57) ABSTRACT

A ultra-miniature, electro-mechanical, MEMS type safe and arming (S&A) device for medium- or large-artillery rounds, including, three sequenced S&A interlocks: a setback slider, which is positioned partially within and partially extending from an arming slider, such that, upon firing acceleration, the setback slider will compress into a channel within the arming slider (unlocking the 1$^{st}$ interlock); freeing the arming slider to move toward its arming position under urging of the round's spin; a stop and release mechanism formed by a flexible latch arm which impacts upon a safety catch located within the frame in which the arming slider is mounted, such that the arming slider is stopped until a release command signal is initiated by the fuze circuit, triggering a spot charge which generates an expanding gas wave that flexes the latch arm from contact with the safety catch (unlocking the 2$^{nd}$ interlock), thereby freeing the arming slider to continue its motion into an arming position (unlocking the 3$^{rd}$ interlock) and aligning the parts of the firetrain within the device, such that upon signal from the fuze circuit an output charge from the device will ignite the acceptor charge within the round.

8 Claims, 13 Drawing Sheets

ULTRA-MINIATURE ELECTRO-MECHANICAL SAFETY AND ARMING DEVICE

CROSS-REFERENCE TO RELATED APPLICATIONS

This application claims the benefit under 35 USC §119(e) of U.S. provisional patent application 61/049,585, filed on May 1, 2008, which provisional application is hereby incorporated by reference.

FEDERAL RESEARCH STATEMENT

The inventions described herein may be manufactured, used, and/or licensed by the U.S. Government for U.S. Government purposes.

FIELD OF THE INVENTION

The present invention relates to a safety and arming mechanism for munitions, and more particularly to munitions which are tube-launched, high-acceleration, high-spin, medium- or large-caliber rounds.

BACKGROUND OF THE INVENTION

The premature detonation of munitions, including artillery rounds, bombs, missiles, and/or mortar shells during handling, shipping, or in storage creates a highly dangerous condition. Various safety and arming (S&A) devices have been proposed in the prior art for preventing accidental arming and premature detonation of munitions. A safety and arming device is now a required element of a munition to ensure that the munition is not armed and detonated prior to the intended time therefore. The safety and arming device is part of a munition's fuze and prevents arming of the fuze until certain conditions are met. Many safety and arming devices require two conditions or occurrences for operation and initiation of the fuze. The first condition utilized is typically setback acceleration, which is associated with the launching of the munition. Setback acceleration of the munition is a convenient condition to sense and measure. The second condition can be based on a number of different parameters, such as barrel escape velocity, timing, sensing and/or counting the turns or rotations of the munition, etc.

One early safety and arming device is the percussion fuze. A percussion fuze is normally held inoperative by a safety device which is released by setback forces developed upon launching a projectile. Such a fuze is shown in U.S. Pat. No. 1,652,635, to Pantoflicek, issued Dec. 13, 1927.

Another proposed safety and arming device includes a fuze wherein movement of a setback slider mechanism pivots a lever. The movement of the lever activates a timing mechanism. The timing mechanism releases a detonator carrier which is moved into an armed position. One such device is shown in U.S. Pat. No. 2,863,393, to Sheeley, issued Dec. 9, 1958.

Still another type of fuze device was proposed in which a slide mechanism responds to setback forces developed during sustained acceleration of a projectile to arm the fuze. Typical devices of this type are disclosed in U.S. Pat. Nos. 2,595,757, to Brandt, issued May 6, 1952; 4,284,862, to Overman et al, issued Aug. 18, 1981; and 4,815,381, to Bullard, issued Mar. 28, 1989.

Other examples of prior art devices that use the setback acceleration condition to arm a fuze include zig-zag gravity weights; escapement mechanisms, such as gravity weight drive escapements; successive falling leaves; and various combinations of such devices. More modem fuzes integrate such features in smaller packages, by employing micro-electromechancial systems (MEMS) based technology and processes, based upon lithographic techniques, or offshoot techniques such as plating, molding, plastic injection, and/or ceramic casting—examples of such applications of MEMS technology are disclosed in a series of patents to Robinson and Robinson et al., including U.S. Pat. Nos. 6,167,809, issued Jan. 2, 2001; 6,568,329, issued May 27, 2003; 6,964,231, issued Nov. 15, 2005; and, 7,316,186, issued Jan. 8, 2008. Such more modern fuzes comply with MIL-STD-1316 or STANAG 4187 standards, requiring that two unique and independent aspects of the launch environment must be detected either mechanically or electronically by the fuze, before the weapon can be enabled to arm itself; including set-back acceleration, rifling-induced spin, gun- or launch-tube exit, airflow, and flight apex. Further, such modern fuzes typically perform targeting functions, which can include electromagnetic or electrostatic target detection, range estimation, target impact detection, grazing impact detection, or timed delay. The best methods to accomplish these functions and provide the required S&A device depends on the characteristics of the weapon system, such as limitations on size, onboard power, desired configuration, and factors such as affordable cost, material selection and compatibility, and safety and reliability standards.

U.S. Pat. No. 6,964,231, incorporated herein by reference, discloses a MEMS fuze (hereinafter the '231 fuze) for medium caliber munitions, such as a 20-mm bursting projectile, designed to meet criteria such as being relatively inexpensive (on the order of several dollars when manufactured in large quantities); extremely small to allow maximum room for the most lethal payload practicable; extremely reliable, to perform under battlefield conditions; and preferably requiring no pre-launch power, since the battery typically does not activate until launch. The '231 fuze incorporates 3 major interlocks in its S&A device: (1) an initial motion of a setback slider in response to acceleration; whereby, the setback slider removes a setback lock lever tab from an arming slider's setback lock catch (a rather complex action), thereby freeing the arming slider; (2) which arming slider under urging of the spin imparted to the projectile, moves part way to arming; whereupon it is impeded by a catch tab, against a command lock catch face within the arming slider; (3) electronics within the fuze, i.e. the fuze circuit, initiates a pre-programmed signal, a signal which may be timed, based upon rotation count, or other desired criteria, to fire a piston against a rocker piston tab, which moves a lock rocker assembly in a complex three dimensional manner, to move the catch tab so as to free the arming slider to continue its motion into the armed position. Once in the armed position, a continuous fire initiation path is established and once the electronics initiate firing, the projectile will explode. Such a continuous, MEMS fire initiation path is disclosed within U.S. Pat. Nos. 7,055,437, and 7,069,861, both to Robinson, et al., issued Jun. 6, 2006 and Jul. 4, 2006, respectively, and both of which are hereby incorporated herein by reference.

As shown in FIG. 15 of U.S. Pat. No. 6,964,231, there is an inflection point, the pivot bend, located at the middle of the three dimensional lock rocker assembly, which is a stress point that has sometimes failed in prototype samples. A prototype '231 fuze has a footprint of approximately 10×10 mm, a relatively large footprint; a rather complex means whereby an independent setback slider initially frees an arming slider; a certainly complex three dimensional lock rocker assembly which finally releases the arming slider to proceed to its armed position, all of which are certainly significant advantages versus conventional (non-MEMS-based) fuzes of the prior art; but there still exist problems in size, reliability, complexity, and cost, regarding the optimum possible fuze, to meet the stated criteria.

SUMMARY OF THE INVENTION

The present invention is an ultra-miniature electro-mechanical, MEMS, safety and arming (S&A) device for gun-launched munitions, i.e. projectiles, that has a footprint of approximately 7×10 mm, and a lower profile or side elevation than the prior art, the '231 fuze, such that it is over 30% smaller by volume. Further, the present invention, eliminates the complex three dimensional lock rocker assembly of the '231 fuze, replacing its functionality with a simple, two dimensional, stop and release mechanism, described below. These and other changes are provided in the present invention, which maintains the full safety functionality of the prior art, in a physically smaller, simpler, more reliable, and less costly device.

The invention is capable of performing safety and arming functions for any munition which is fired from a rifled, tube launcher, which creates an environment of launch acceleration and spin. Such munitions include, but are not limited to: 25 mm High Explosive Airburst (HEAB) Munitions, for systems such as XM25 Integrated Airburst Weapon System; 25 mm Point Detonating Munitions, for systems such as M242 Bushmaster Chain Gun (Bradley Fighting Vehicle); 30 mm cannon caliber fuzes, for systems such as MK44 Bushmaster II Chain Gun, M230 Chain Gun (Apache Helicopter); 40 mm medium caliber fuzes, for systems such as M430A1, M433, M550, M549A1, M918TP for MK19 Machine Gun and M203 Grenade Launcher; 105 mm artillery fuzes; 155 mm artillery fuzes, for systems such as Precision Guided Kit, M762A1 and M767A1 Electronic Time Fuzes; High-explosive dual purpose grenades; submunition grenades and mines; fuzing functions in rockets and missiles.

Specifically, the present invention is comprised of a MEMS assembly composed of four (4) layers, the first layer containing an explosion initiator assembly, which is electrically connected to the fuze circuit and which contains two spot charges. The first spot charge is initiated by the fuze circuit to clear a stop and release mechanism, i.e. a mechanical interlock, as described below. The second spot charge is initiated by the fuze circuit to initiate the firetrain that results in detonation of the projectile, such as and similar to the firetrain disclosed in U.S. Pat. No. 7,055,437, mentioned above.

The second layer is a cover assembly, which focuses and transfers the force of the first and second spot charges to a third layer containing the MEMS S&A mechanism assembly. The MEMS S&A mechanism assembly contains a setback slider which in its normal, pre-firing position extends perpendicularly from and forward of the center of the arming slider, so as to block the motion of the arming slider. Upon firing of the projectile, the setback slider is deflected downward under the firing acceleration and is compressed and depressed into a track, or channel, within the arming slider, nesting and being locked within the arming slider (removing the $1^{st}$ S&A interlock); such that, the arming slider, with the added mass of the setback slider now contained therein, and with an eccentric center-of-gravity, will respond to the urging of the projectiles spin to slide within a track, generally perpendicular to that of the setback slider, toward its armed position. As the arming slider moves towards its arming position the mechanical interlock mentioned above blocks its movement. The mechanical interlock is formed of a flexible arming slider latch arm extending from the arming slider, which latch arm impacts and is impeded by a safety catch located along the track within which the arming slider slides, stopping the arming slider prior to its armed position.

As mentioned above, upon receiving a command from the projectile's electronics, i.e. the fuze circuit, the first spot charge is ignited within the a cover assembly layer of the MEMS device, and the force therefrom is directed through the cover assembly, into a gas expansion chamber, within the MEMS S&A mechanism layer; wherefrom, the force is directed so as to push the flexible arming slider latch arm out of contract with the safety catch and into a recess within the arming slider (removing the $2^{nd}$ S&A interlock); thereby, allowing the arming slider to continue to travel and lock in its armed position. Once the arming slider is locked into its armed position (removing the $3^{rd}$ S&A interlock), a continuous fire initiation path, or firetrain, is established through the four MEMS S&A assembly layers, such that, as mentioned above, when the second spot charge in the first layer is initiated by the fuze circuit, the energy therefrom travels through the now continuous firetrain in the second and third layers and into the fourth layer, an output base, which contains an output charge. This energy from detonation of the output charge, in turn, will detonate an explosive acceptor charge external to the present MEMS device, the explosive acceptor charge, sometime called a relay, lead or booster charge, which will, in turn, ignite the warhead of the projectile.

In an alternative embodiment, detailed below, the functionality of the fourth layer is incorporated in the third layer, such that the third layer contains the S&A mechanism and the output charge. In this embodiment, a transfer charge within the third S&A mechanism layer, the same transfer charge included in the S&A mechanism layer in all of the other embodiments, is aligned adjacent to the output charge and separated therefrom by only thin membranes—such that when the three S&A interlocks are cleared, the firetrain will trigger the transfer charge, and the transfer charge will trigger the adjacent output charge; which will trigger the acceptor charge external to the S&A device. This alternative embodiment, further miniaturizes and simplifies the subject S&A device, leading to further cost savings and reliability.

If, for whatever reason, the setback slider is not fully depressed and locked into position within the arming slider, the arming slider will be physically blocked from moving into its armed position. If, for whatever reason, the first spot charge is not ignited by the fuze circuit, the arming slider will remain blocked by the arming slider latch arm and corresponding safety catch and will be blocked from moving into its armed position. If, for whatever reason, the armed slider does not move into its armed position, the firetrain between the second spot charge and the output base will not be established and any force released from the ignition of the second spot charge will be physically blocked from reaching the output base. Therefore, without each of these actions happening in sequence, the output charge will not be ignited and the warhead of the projectile will not be ignited.

The nature of the subject invention will be more clearly understood by reference to the following detailed description, the associated drawings, and the appended claims.

BRIEF DESCRIPTION OF THE DRAWINGS

In the drawings, which are not necessarily to scale, like or corresponding parts are denoted by like or corresponding reference numerals.

DETAILED DESCRIPTION OF THE INVENTION

A first embodiment of the invention is shown in FIGS. 1 through 9.

The safety of the safety and arming device of a fuze derives from the highly selective mechanical and electro-mechanical logic intrinsic to the design. As will be described, environmental stimuli of unique direction, threshold, sequence, and duration are necessary to effectuate the arming sequence in the mechanical logic. Environmental inputs that do not match the launch/dispense sequence result in one of two outcomes: a) the mechanical logic elements may partially respond to the inputs and then reset to their original "safe" (unarmed) position, or b) the mechanical logic elements may partially respond to the inputs and due to the out-of-sequence or improper nature of the inputs the mechanical elements may finish in a "failed safe" condition.

Description of the S&A Assembly and Explosive Train

The core of the inventive design is the miniature safety and arming mechanism 100, preferably fabricated using micromachining or MEMS technology (e.g., lithography, plating and molding) to obtain the desired precision and tolerances, shown in plan view in FIG. 1, and described below. The remainder of the inventive design, including provisions for fuze circuit interface, explosive buildup and transfer, and assembly and packaging, is similar to the assembly described in U.S. Pat. No. 6,964,231, in that the assembly comprises or may comprise, an initiator board/fuze interface board that ignites the initiating explosives, a cover plate containing explosives and permitting explosive build-up, a MEMS frame and a parts layer that in response to inertial environments manages the position of a key movable firetrain element in relation to input and output explosive trains, as will be described, and an explosive output or base plate which augments and directs explosive output. The differences embodied in the inventive design, as will be shown, are the need for fewer parts, simplified operation, more robust lock mechanisms and lock actuation, potential for improved manufacturability, and reduced footprint or size, over the prior-art design.

Figure 1:
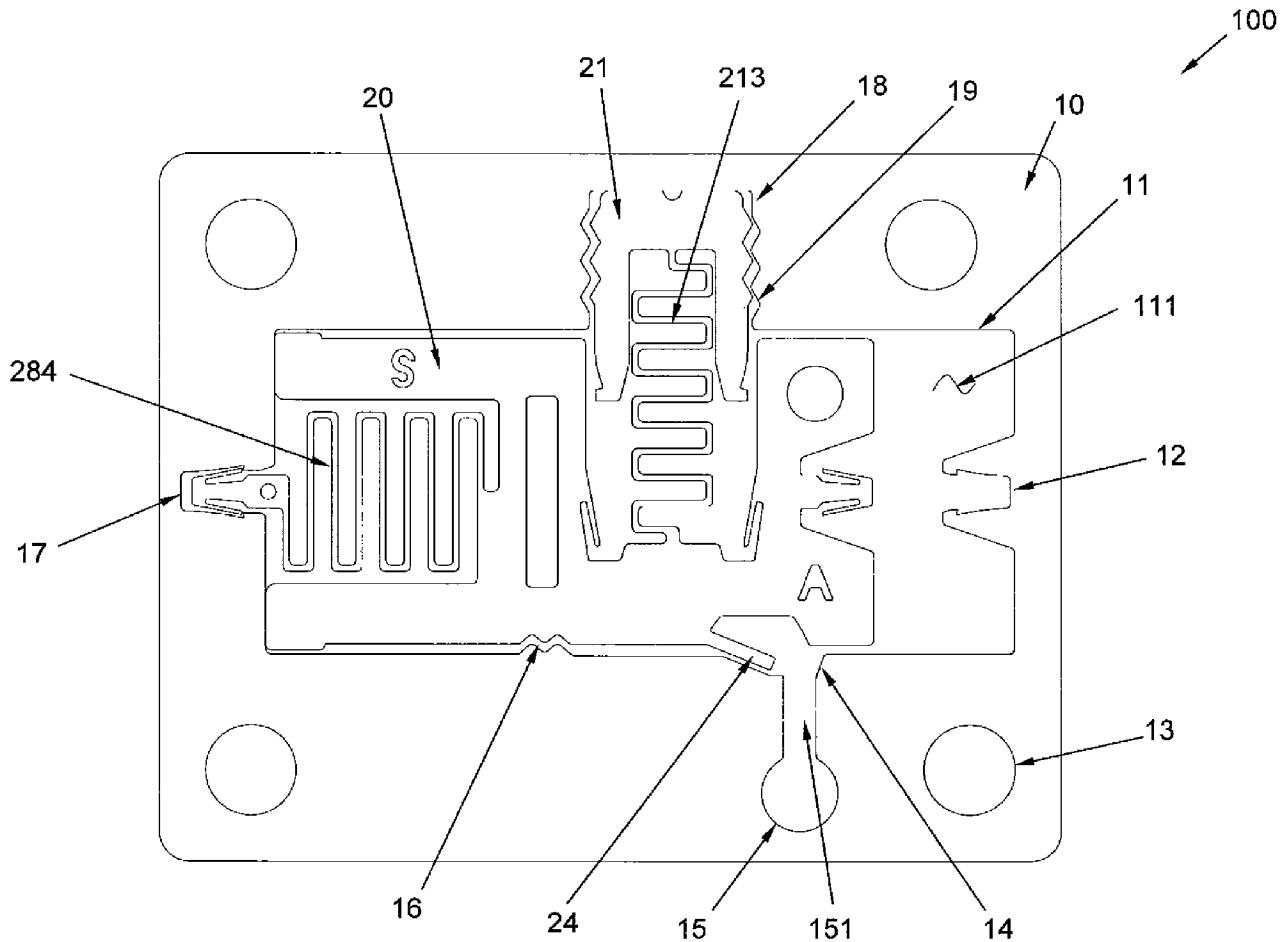
FIG. 1 is a plan view of a first embodiment of the MEMS S&A mechanism assembly.
Figure 2:
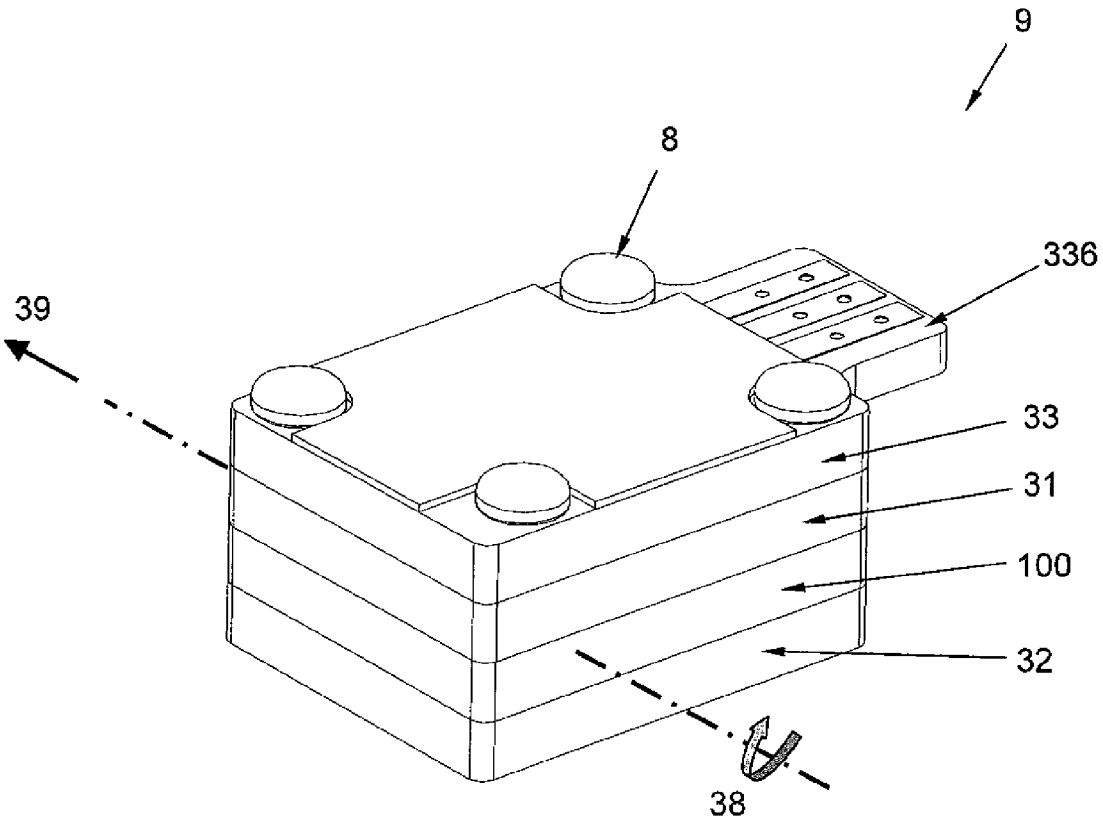
FIG. 2 is an isometric view of a first embodiment of the fully assembled S&A.
Figure 3:
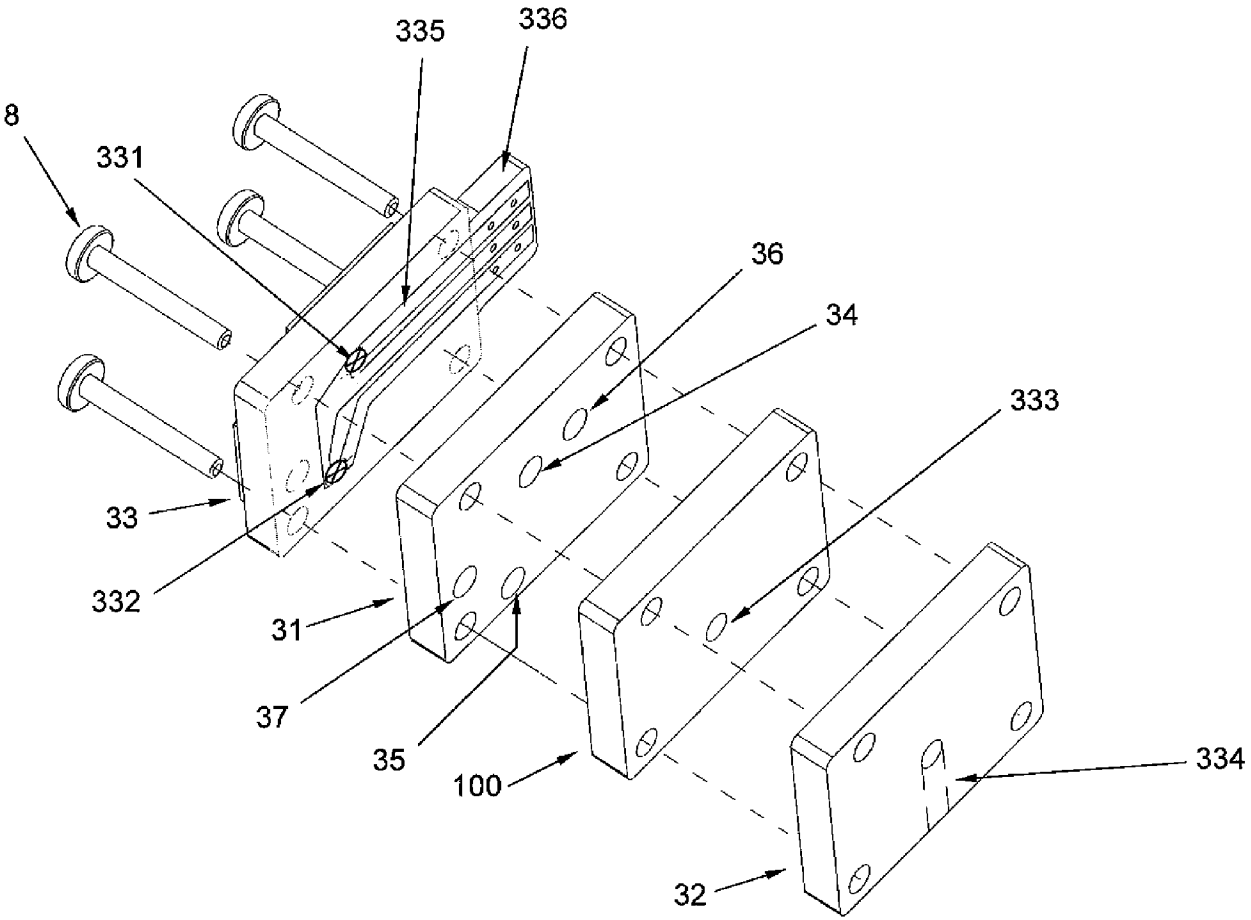
FIG. 3 is an isometric exploded view of a first embodiment of a fully assembled S&A.
Figure 4:
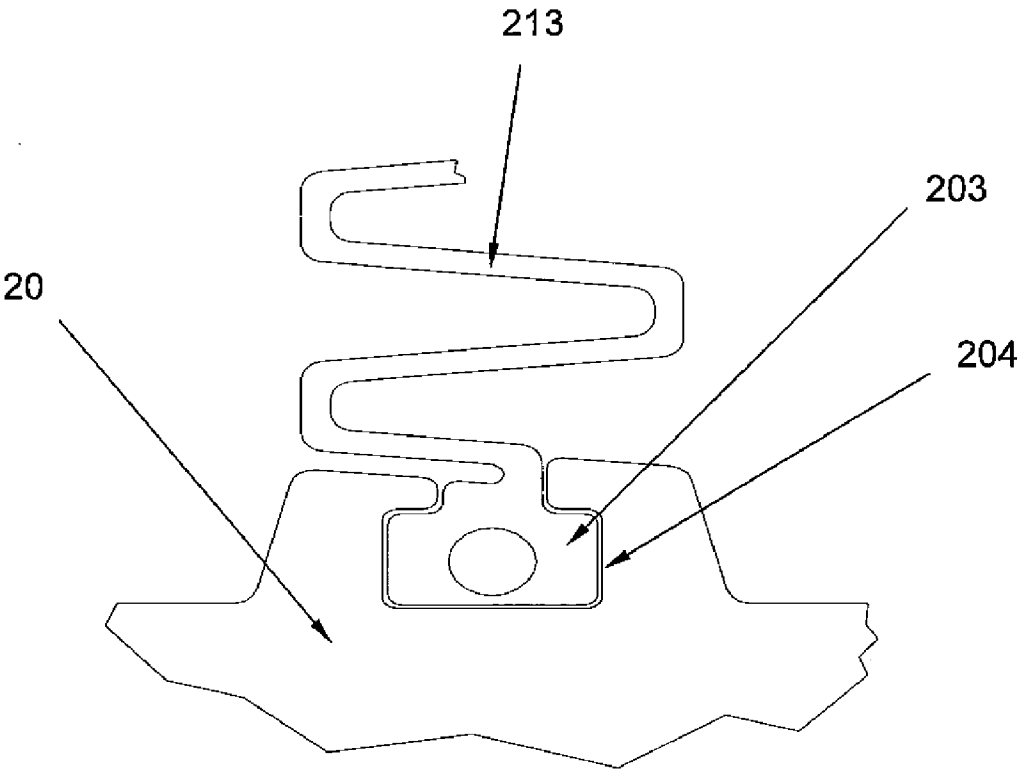
FIG. 4 is a plan view of a simple method to join separate arming and setback sliders into a setback and arming mechanism (SAM)

The inventive MEMS S&A assembly 9, FIG. 2, comprises 4 layers, an initiator board assembly 33, a cover assembly 31, a MEMS S&A mechanism assembly 100, and output explosive assembly 32, all held together by a screw, rivet, welded pin or other fastening means, represented in FIG. 3 by pins 8. The features of FIG. 2 are shown in exploded view with other details in FIG. 3. For operation in the fuze of a tube- or gun-launched munition the direction of travel 39 and axis of spin 38 are as shown in FIGS. 1 and 2.

Figure 5:
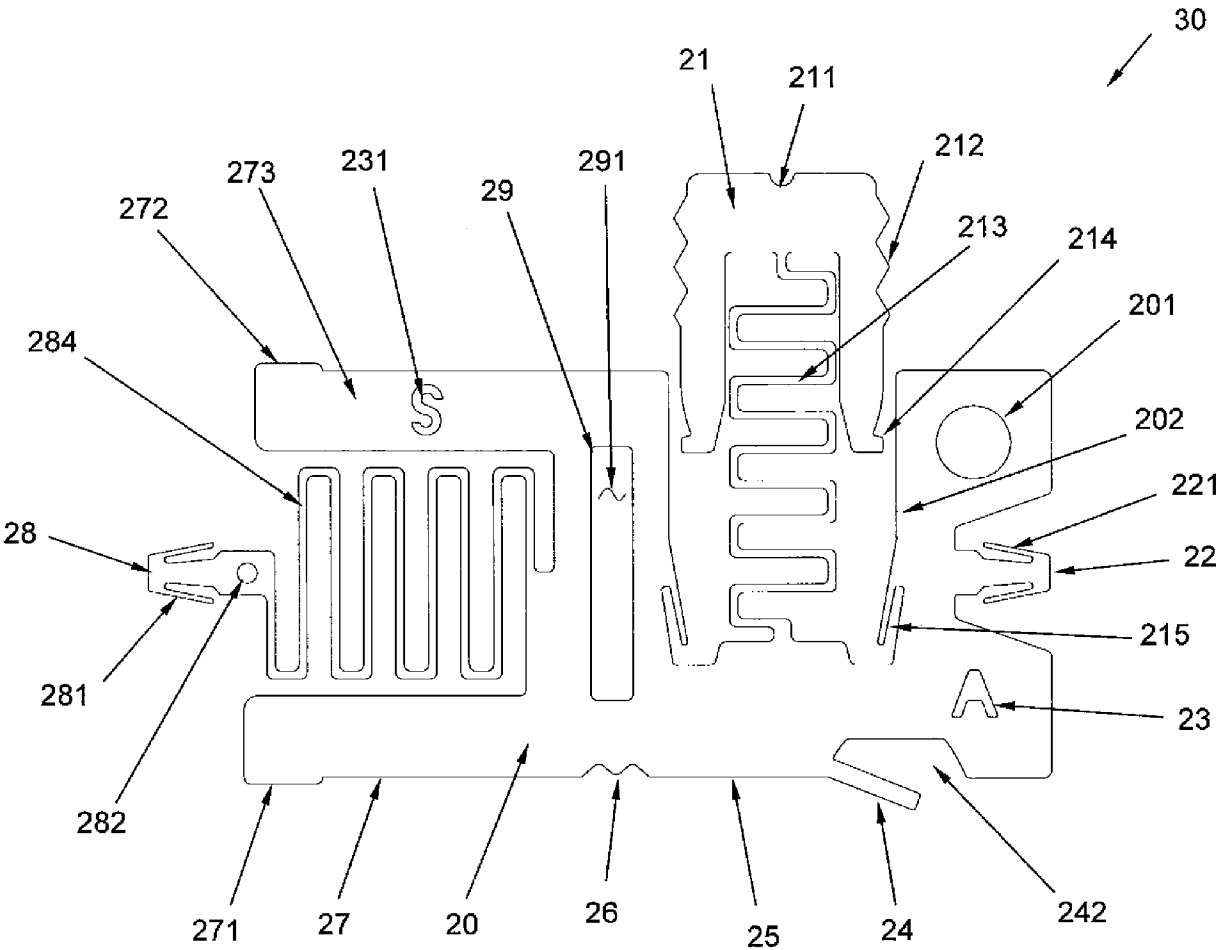
FIG. 5 is a plan view of the SAM.

The MEMS mechanism layer 100, FIG. 1, comprises a preferably metal frame 10 and a preferably metal setback and arming mechanism (SAM) 30, FIG. 5, that preferably combines an arming slider 20 and a setback slider 21 into one integral piece. One alternative configuration is to manufacture the arming slider 20 and the setback slider 21 separately and join them using an attachment method, such as the one depicted in FIG. 4 where a setback spring head 203 inserts into a setback spring head socket 204 that is fabricated into a modified arming slider.

The S&A frame 10, FIG. 1, permanently fixed to substrate 111, constrains and guides the motion of the moving parts of the SAM 30, including the setback slider 21 and the arming slider 20, both shown in FIG. 1. As stated above, metal is the preferred material for both frame 10 and substrate 111, for strength, ductility and explosive confinement. Arming slider travel slot 11 guides and constrains the in-plane motion of the arming slider as it progresses from a safe to an armed position. At one end of the travel slot there is an arming-slider bias spring head socket 17 into which the head 28 of bias spring 284 clips by the action of flexible latch barbs 281 acting against catch features in socket 17. During S&A assembly, the bias spring head 28 is extended while in plane into socket 17, into which it clips, to ensure a spring tension that biases the arming slider 20 away from the armed position. At another end of the travel slot 11 there is a similar latch socket 12 that secures the fully travelled arming slider in an armed position.

Setback slider travel slot 18 guides and constrains the in-plane motion of the setback slider 21 as it progresses from a starting position straddling both the frame and the arming slider to an ending position when it is fully nested inside the arming slider 20. In the straddling position, shown in FIG. 1, the setback slider's body itself prevents lateral advancement of the arming slider toward an armed position, by locking it, essentially acting as a "bolt" in the sense of a bolted door lock. In the unlocked position, FIG. 6, the setback slider 21 has fully deflected downward and latched into a nested position in the arming slider 20. Setback slider travel slot 18 has left and right zig-zag tracks or rack teeth that engage with the setback slider 21, forcing it side to side as it travels down slot 18. This enforced side-to-side motion causes "inertial damping" of the slider to slow its progress down the track during sudden impacts or acceleration, to provide what is known in the fuzing art as 40-foot drop safety. The setback slider mass 21, the spring 213, and the zigzag tracks are designed to prevent full travel of the setback slider for any impact or impulse producing less than 50 ft/sec change of velocity, corresponding to what happens in a 40-foot drop during shipping or handling.

The frame also incorporates a set of arming slider travel slot rack teeth 16 that engage with a similar set of rack teeth 26, FIG. 5, on the arming slider 20 when setback acceleration is applied during launch. This engagement prevents the arming slider 20 from moving toward an enabled position or an armed position until after tube exit (cessation of setback acceleration) occurs.

Figure 7:
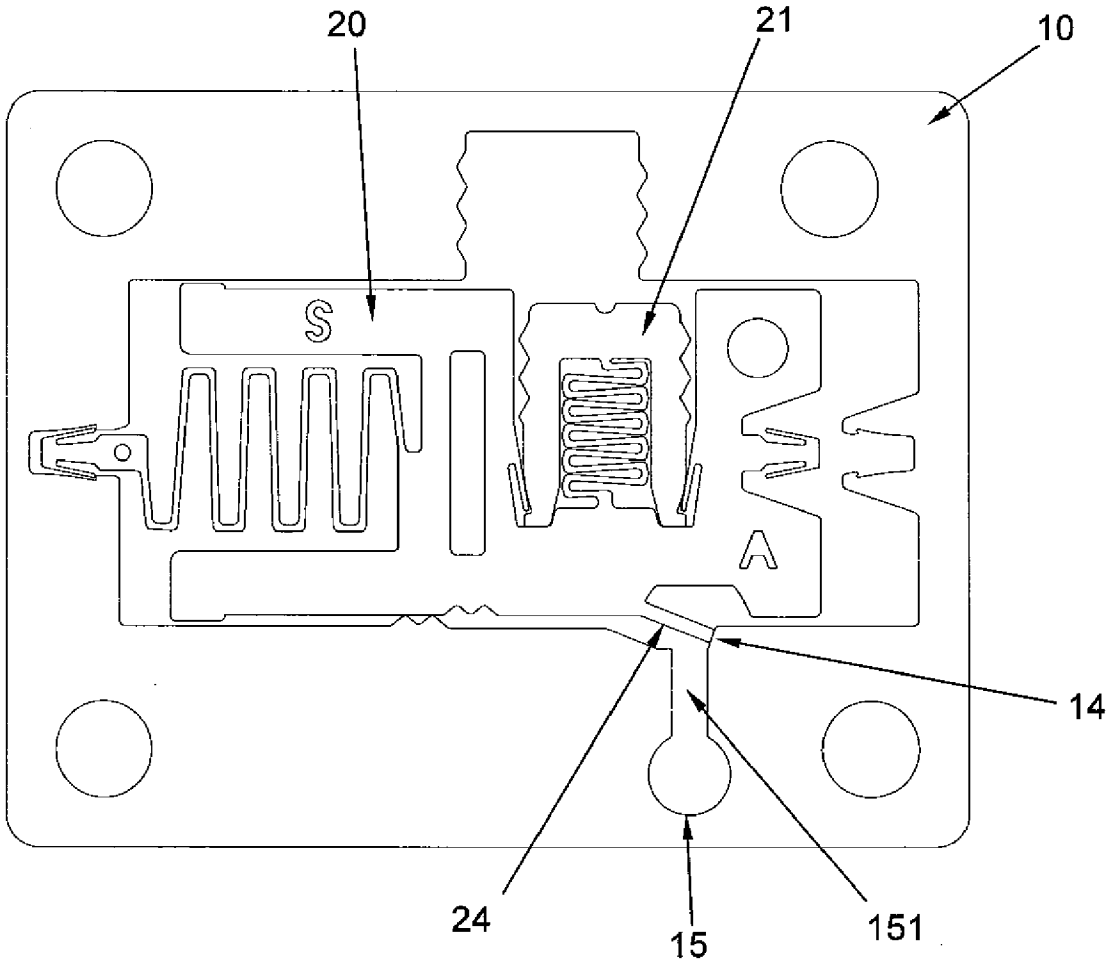
FIG. 7 is a plan view of the first embodiment of the MEMS S&A mechanism assembly, showing the arming slider in a second safe position but with the second safety lock enabled.

Additionally, the frame 10 incorporates a gas expansion chamber 15 that directs propellant gases coming from the command initiator bridge and command initiator spot charge 332, FIG. 3, along a nozzle or duct 151, FIG. 7, that opens to the arming slider latch arm 24, when the arming slider is in the "second-safety-lock enabled" position. The nozzle 151 helps in creating powerful directional flow of expanding gases toward the arming slider latch, as will be explained. Extending along one side of the gas expansion chamber 15 is the arming slider safety catch 14.

Figure 8:
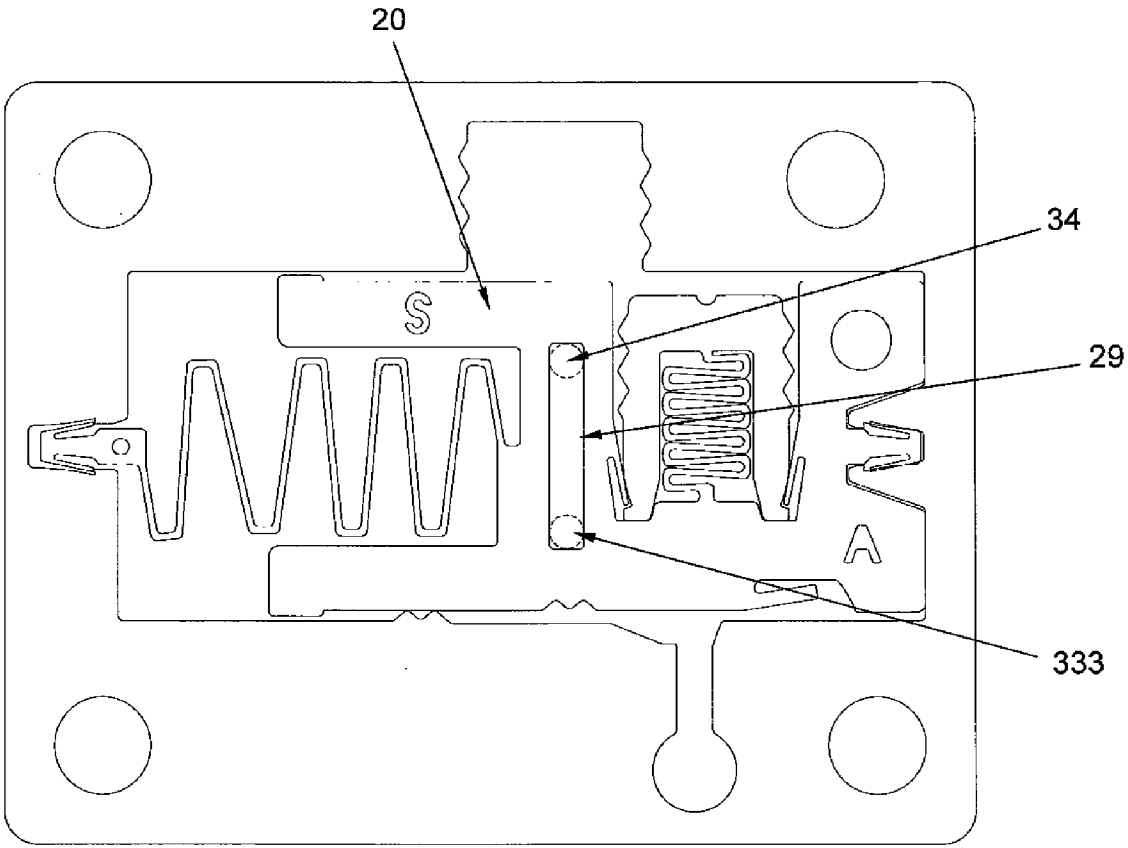
FIG. 8 is a plan view of the first embodiment of the MEMS S&A mechanism assembly, showing the arming slider in the armed position.

Finally, a blind hole 333 in FIG. 3 contains a receptor charge that is detonated, when the arming slider is in the armed position, by the explosive output of the transfer charge held in pocket 29, FIG. 8. Variations in the design might allow for a through hole instead of a blind hole but having a thin membrane at the top of the blind hole seals the MEMS mechanism against contamination by grains of explosive. The receptor charge in turn detonates the output charge in the output explosive assembly, 32.

The arming slider 20, FIG. 5, comprises a mass (the arming slider body itself), an integral bias spring 284 with spring bias latch head 28 with latch barbs 281 and bias spring head probe hole 282, upper arming slider arm 273 with riding bump 272, lower arming slider arm 27 with riding bump 271, an end-of travel arming slider latch head 22 with latch barbs 221, a transfer charge pocket 29 with or without transfer charge floor membrane 291, a setback slider travel slot 202, setback slider latch barbs 215, arming slider latch 24 and latch actuation cavity 242, armed indicator 23, safe indicator 231, rack teeth 26, and manipulator probe hole 201. As shown in FIG. 1, arming slider 20 is located within a groove within the MEMS S&A mechanism layer 100, the groove forming an arming slider travel slot 11, atop a substrate 111.

The setback slider 21, FIG. 5, is constrained to move on top of substrate 111 and inside travel slot 18 in the frame 10, FIG. 1, and subsequently, during arming, inside setback slider travel slot 202, FIG. 5, and is held in plane by cover assembly 31, FIGS. 2 and 3. As shown in FIG. 5, the setback slider 21 comprises a mass (the setback slider body itself) with rack teeth 212 on portions of its lateral sides, an integral reset spring 213, preferably compressed somewhat during S&A assembly to fit into track 18 to provide a spring bias force, a probe pocket 211, and latch catches 214.

The initiator board assembly 33, FIGS. 2 and 3, comprises a laminated circuit board or flex circuit with a bottom dielectric layer, a middle lamination having electrically conductive traces 335, that also incorporate thin film bridges, and a section for electrical connection to the fuze, shown as edge card connector 336 and a preferably transparent top lamination to cover the safe and armed indicator viewports, 36 and 37, respectively.

Additional holes in the bottom dielectric layer give access to, and provide explosive loading volume for, two or more initiator bridges, with two bridge locations shown in FIG. 3 at 331 and 332. Primary explosive spot charges, such as lead styphnate (LS), are loaded on top of the thin film or other type bridges at those locations. A firetrain initiator bridge circuit leads to a spot charge 331, which when electrically stimulated, serves to initiate the train of micro-scale explosive components inside the MEMS S&A that build up to detonating output to initiate the weapon firetrain. A command initiator bridge circuit and associated spot charge 332, when electrically stimulated, serves to generate gases that flow through the command hole 35 in the cover assembly 31 to pressurize gas expansion chamber 15 to actuate the flexible arming slider latch 24, forcing it into the latch activation cavity 242, FIG. 5, and freeing it from contract with the safety catch 14.

Firetrain initiator bridge circuit and fire train initiation spot charge 331 align with and fire into input explosive column 34, that is loaded inside a through-hole in the cover assembly 31, to initiate it.

Alignment holes near the corners of initiator board 33 line up with holes 13 in the S&A frame 10 and with holes in the other stacked components as shown in FIGS. 2 and 3, for fastening the S&A frame 10 together using screws 8.

The cover assembly 31 protects and mechanically constrains the MEMS S&A mechanism 30, FIG. 5, within S&A frame 10, FIG. 1, to operate in-plane in the MEMS frame 10, MEMS mechanism layer 100. The cover assembly 31 also assists transfer of, focuses, or amplifies the explosive or energetic output from the two initiator bridges and spot charges in the initiator board assembly 33. Typically, command hole 35 conducts expansion gases from bridge and spot charge 332 through the cover layer and into the gas expansion chamber 15 in the MEMS layer. And typically, input explosive column 34, loaded into the cover assembly, is ignited by bridge and spot charge 331 at the top side of the cover and then builds to a detonation prior to output at the bottom side of the cover, as explained in prior-art U.S. Pat. Nos. 7,055,437 and 7,069,861.

Output explosive assembly 32 FIG. 3 typically comprises a metal base with an output charge cavity 334 into which an output explosive charge is placed. The output charge and cavity may be configured to fire straight through the plane of the base, or laterally out any of the edges or in any direction as needed to function in the particular projectile. As shown in FIG. 3, cavity 334 fires out an edge of the output base. The dotted lines indicate the output charge may be protected by a membrane of material that is part of the base. The receptor charge filling hole 333, in frame 100, is a secondary-explosive charge which fires into and detonates the charge in output charge cavity 334.

When the arming slider 20 is in the armed position, FIG. 8, the transfer charge in cavity or pocket 29 is aligned with input explosive column 34 above it, inside the cover assembly 31, with the location indicated in FIG. 8 by the dotted circle 34, and is aligned with the receptor charge in receptor charge hole 333, FIG. 3, below it, inside the frame's substrate 111, with the location indicated in FIG. 8 by dotted circle 333. Typically, input column 34 is filled with a combination or stack of primary (sensitive) and secondary explosives, the transfer charge is composed of secondary (less sensitive) explosives, the receptor charge is composed of secondary explosives, and the output explosive charge that fills output charge cavity 334 is composed of secondary explosives.

When the arming slider 20 is in the safe position, FIG. 1, the transfer charge is not aligned with the input explosive column 34 above it, nor is it aligned with the receptor charge in receptor charge hole 333 below it, and in fact the transfer charge is held some lateral distance away from both charges, and the input column 34 is not aligned with receptor charge hole 333 so there can be no unintended explosive transfer between them, as is explained in full in U.S. Pat. No. 7,055,437.

Description of Second Embodiment, 3 MEMS Assembly Layers

Figure 10:
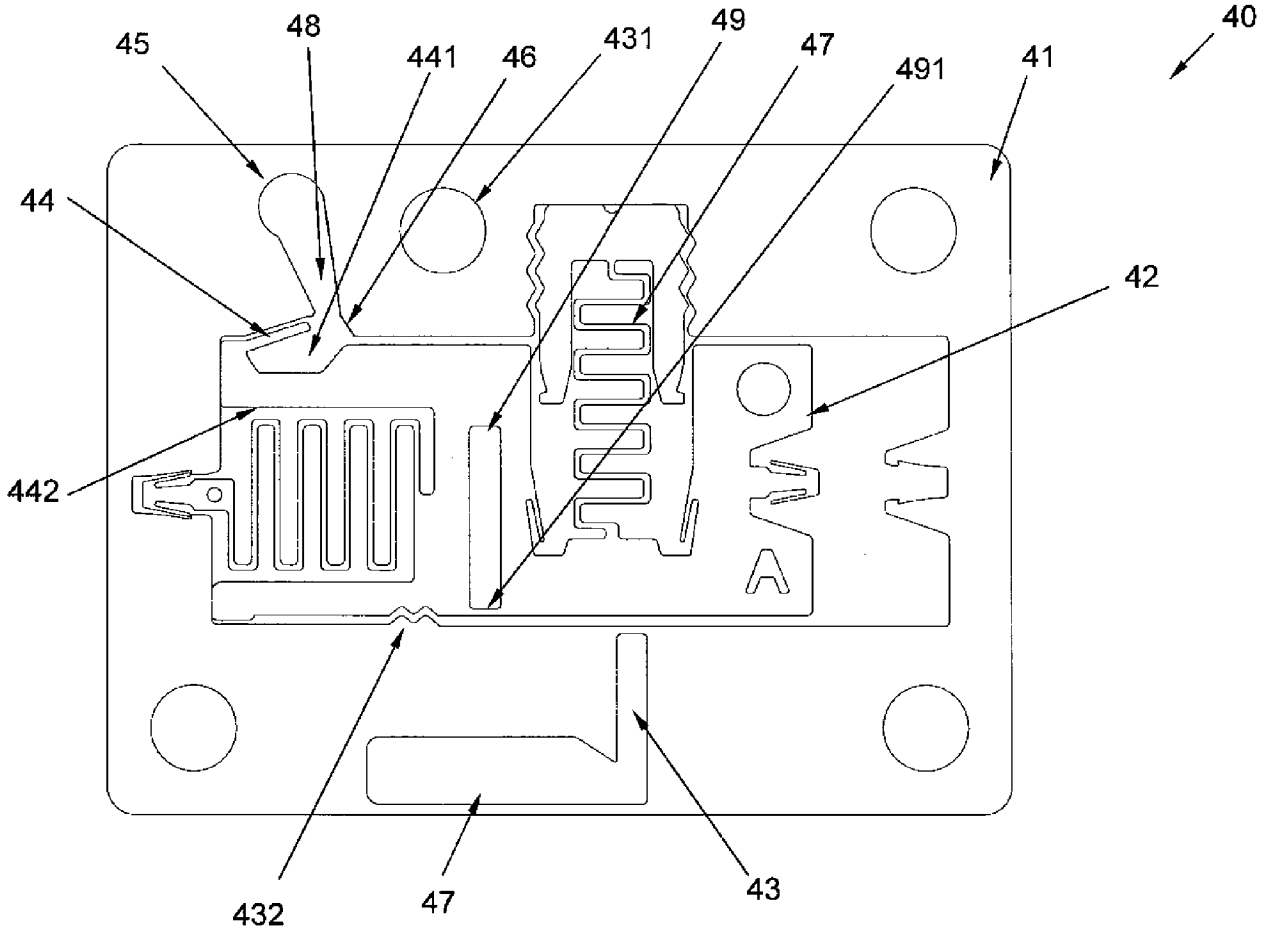
FIG. 10 is a plan view of a second embodiment of the MEMS S&A mechanism assembly.

In a second S&A mechanism embodiment 40, FIG. 10, the second safety interlock of the first embodiment, containing a gas expansion chamber 15 with nozzle 151 and safety catch 14, all part of the frame, and the arming slider latch 24 and the latch actuation cavity 242, both part of the arming slider, have all been re-oriented and moved across the die, to appear in ensemble, as gas expansion cavity 45 and nozzle 48 with catch 46, all on the second-embodiment frame 41, along with second-embodiment arming slider 42 having arming slider latch arm 44 and latch actuation recess 441, FIG. 10, built into an upper catch arm 442. This ensemble of features was moved across the die to permit implementation of a second-embodiment in-plane micro-scale firetrain which is initiated by an input explosive charge (in a cover assembly, not shown) that initiates a transfer charge in transfer charge pocket 49, which has a flat edge and a thin membrane or wall 491 to permit a lateral explosive output, that in turn impinges laterally out the bottom edge of the second-embodiment arming slider 42, across a gap and through two thin membranes, into receptor charge pocket 43 and output charge pocket 47.

To integrate the above-described variations of this second embodiment, other features from the first embodiment one are rearranged as well, specifically: rack teeth mesh 432 has been moved to the left compared to rack teeth 16 and 26 in the first embodiment; one of the through-holes 13 has been shifted to the side to become shifted alignment hole 431 in the second embodiment; the safe indicator symbol has been removed from the upper arm and the safe indication feature is now aiming slider latch arm 44, visible through an observation port in a revised initiator board and cover assembly. The second-embodiment initiator board and cover plate (neither shown) relocate the signal traces 335, the initiator bridges and spot charges 331 and 332 and cover assembly holes 35 and 36 and the viewports 36 and 37 to align with the second-embodiment features described above. In addition, the output explosive assembly 32 is eliminated along with receptor charge hole 333 and its thin membrane because in the second embodiment the explosive firetrain develops and outputs in the plane of the MEMS S&A mechanism 40, FIG. 10. The height of the S&A stack can be reduced by the thickness of the output assembly 32, in the second embodiment.

The safety and arming functions and logic of the second embodiment are the same as for the first embodiment.

Description of Third Embodiment, Rotating 3$^{rd}$ S&A Interlock

Figure 11:
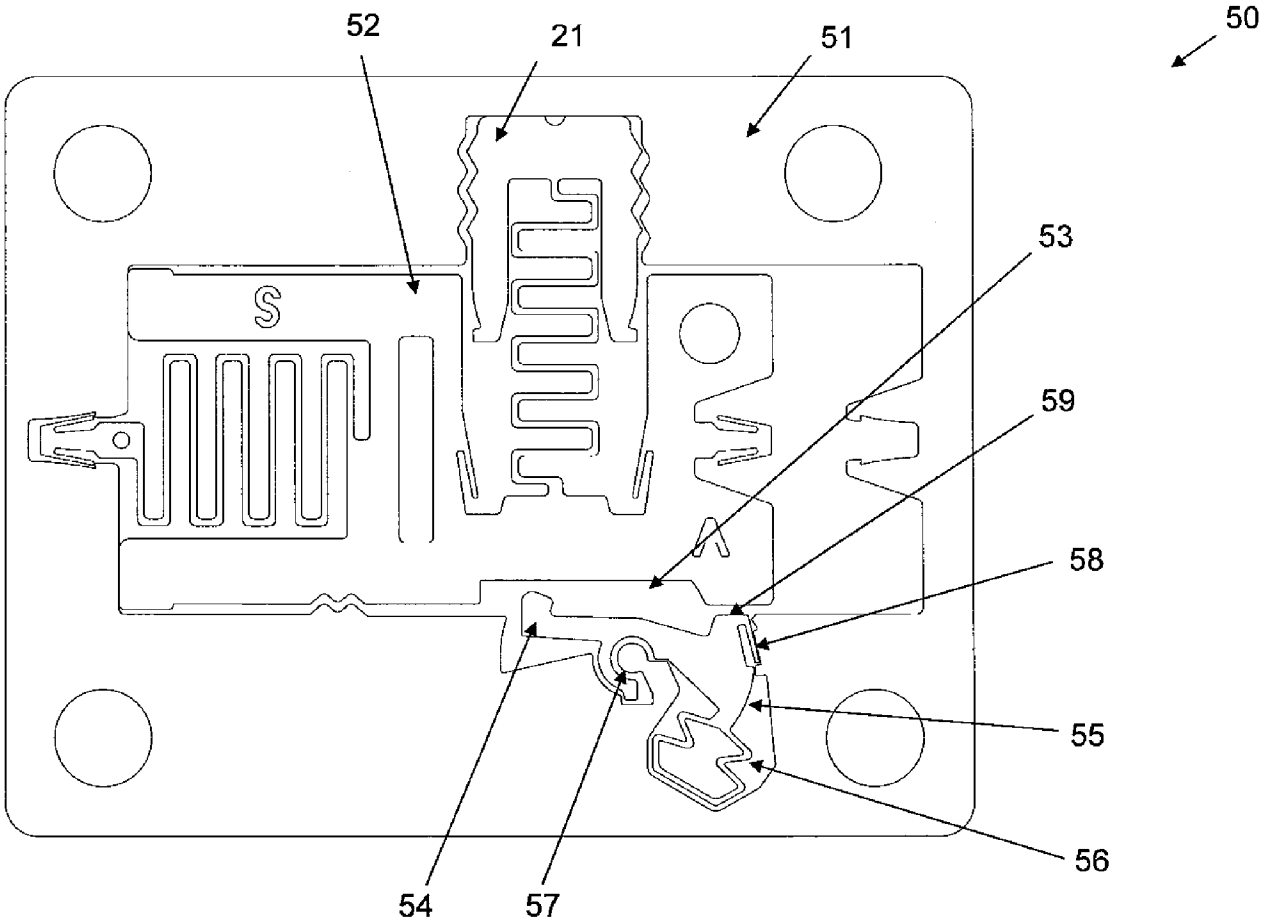
FIG. 11 is a plan view of a third embodiment of the MEMS S&A mechanism assembly.

In a third embodiment, FIG. 11, an S&A mechanism 50, analogous to 100 in the first embodiment, incorporates a modified frame 51, a modified arming slider 52 with a rotor recess 53, and a bellows-rotor assembly 55 consisting of a rotor head 54, rotor latch 58, rotor tab 59, actuator bellows 56, and actuator pivot assembly 57. The electromechanical logic of this third embodiment is the same as for the first embodiment, but the means of implementation depends in this embodiment on the command initiator bridge and spot charge 332 output gas-expansion to expand bellows 56 and rotate the rotor of rotor assembly 55 to remove the second safety lock from the modified arming slider and the operation of a bellows and a rotor latch. The bellows-rotor assembly fits into a matching socket suitably fabricated into the modified frame 51 such that a pivot assembly 57 is operable to permit the rotor assembly to rotate enough to change its locking relationship with the modified arming slider 52.

In the configuration shown in FIG. 11, the rotor head 54 is positioned somewhat inside the left end of rotor recess 53, on a portion of the head on a line that would interfere with full rightward motion of the modified arming slider. The rotor head is secured in that position by the rigidity of the preferably metal bellows 56 at the other extent of the rotor assembly 55 and an engagement with the pivot assembly 57. There is also some resistance to rotation supplied by the latch 58. Further, the rotor assembly 55 positively cannot rotate counterclockwise to remove the rotor head from interfering with the modified arming slider because rotor tab 59 is situated immediately opposite a solid portion of the fully-safe slider 52 near the right end of the modified arming sliders' rotor recess, such that there is an interference. In this configuration, rotor assembly 55 is not "enabled" to function (i.e., to rotate CCW due to gas expansion in the bellows 56) because the above-noted interference would prevent its rotation.

Figure 12:
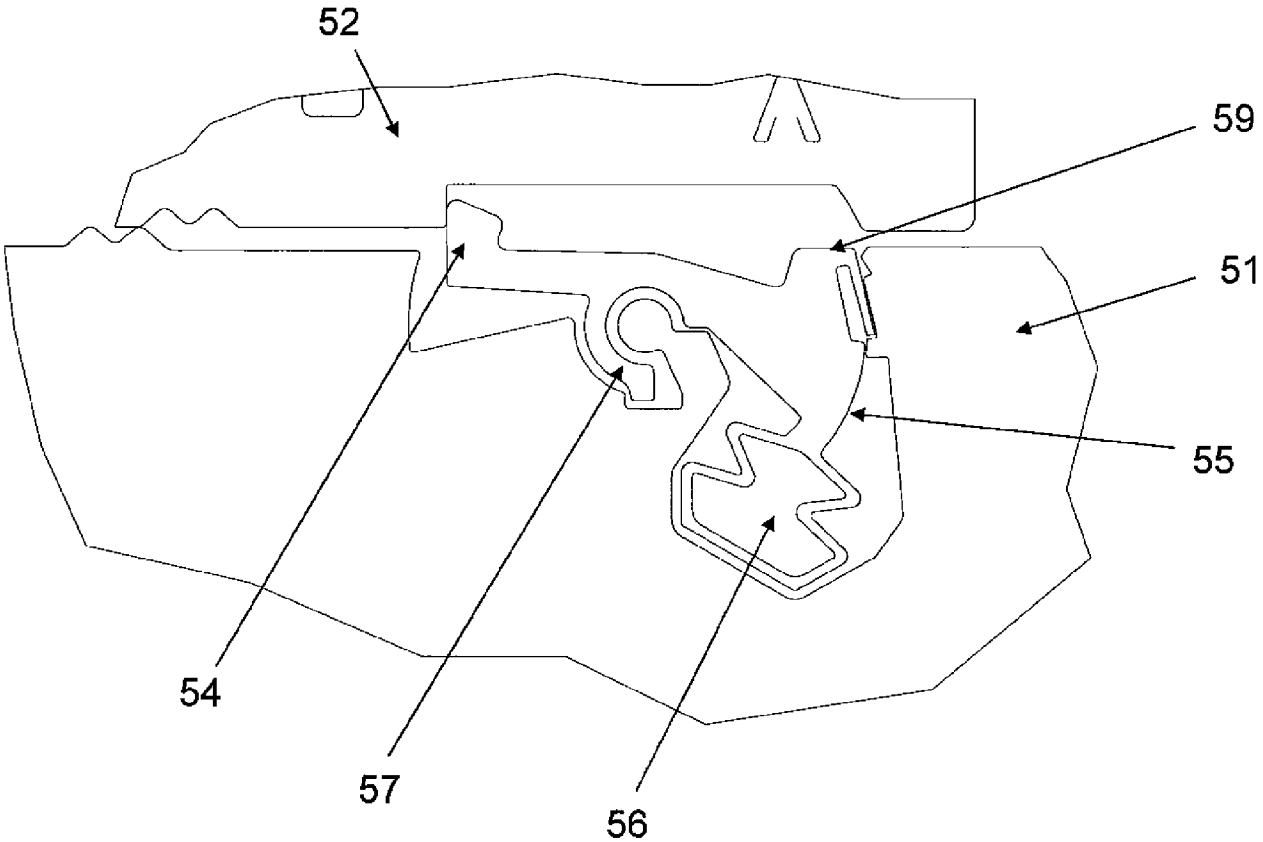
FIG. 12 is a plan view of a bellows rotor assembly of a third embodiment in its enabled position.

The rotor assembly, however, can become "enabled." As in the first embodiment, the arming process of embodiment three begins with deflection of the setback slider 21 downwards into the arming slider and its subsequent latching. Then once the munition is out of the launch tube, the arming slider is free to move rightward under centrifugal acceleration induced by spin about the assembly spin axis, FIG. 2. The modified arming slider will accordingly move rightward under spin acceleration until a left end of the rotor recess comes into contact with rotor head 54, FIG. 12, at which point further rightward motion of the modified slider is prevented. This second locking of the arming slider, coming sequentially after launch setback acceleration and tube exit, constitutes operation of the second safety lock. But the rightward motion of the modified arming slider up to the point of contact with rotor head 54 is sufficient to clear the prior interference with rotor tab 59. In the configuration of FIG. 12, the second safety lock release is "enabled".

Figure 13:
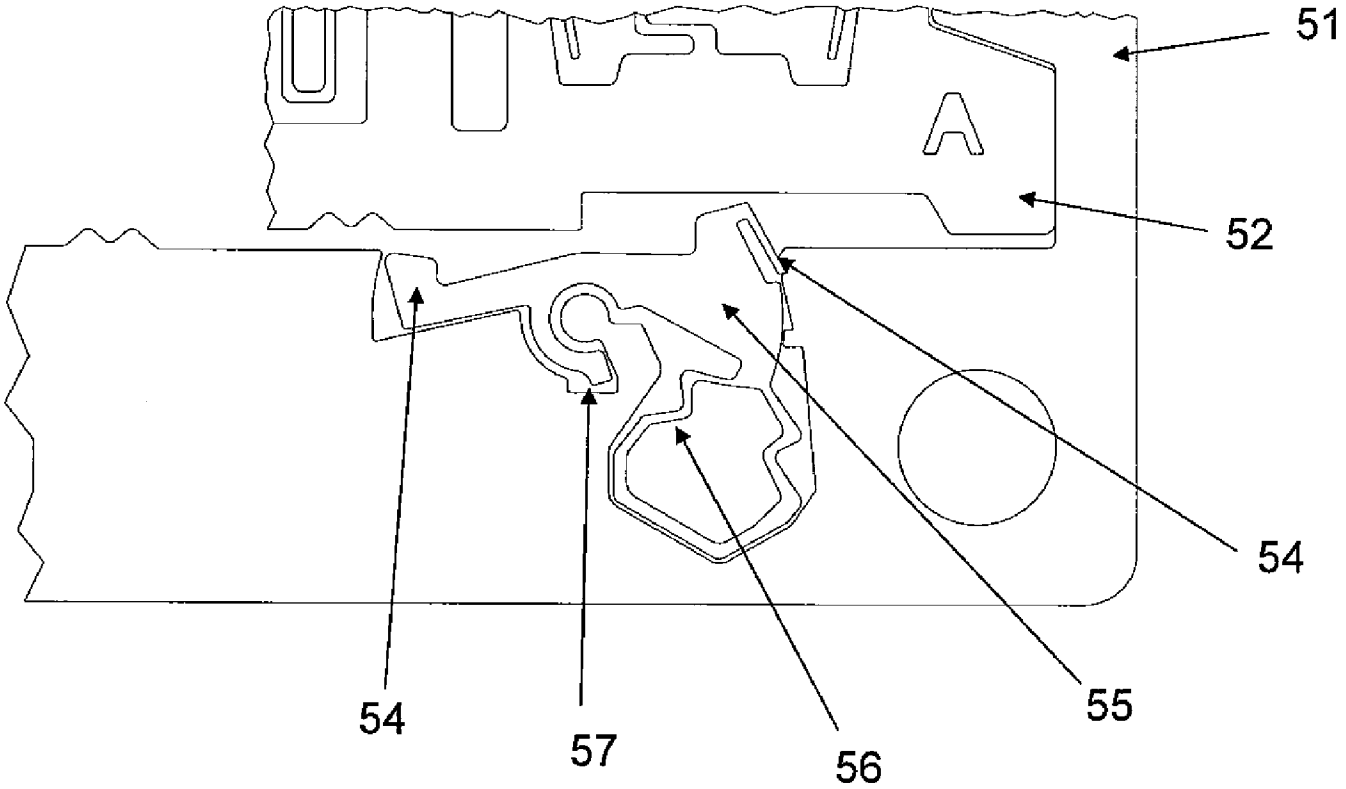
FIG. 13 is a plan view of the bellows rotor assembly of a third embodiment in its expended position and the modified arming slider in its armed position.

Once enabled, the fuze circuit can fire the command initiator bridge and spot charge 332 to pressurize command initiator hole 35 to force an expansion of bellows 56, to rotate the bellows rotor assembly 55 counterclockwise from its first position, to disengage rotor head 54 from contact with modified arming slider 52, to allow the arming slider to continue to move rightward under a persisting centrifugal force due to spin about the spin axis 38, until the modified arming slider reaches its end of travel and latches in place in its armed position, FIG. 13. At the same time, as the rotor assembly is pushed counterclockwise by expanding bellows 56, latch 58 can engage with a catch on modified frame 51, to secure the rotor in its second position.

Operation

From the point of manufacture to the point of use the subject MEMS S&A will experience diverse dynamic and inertial inputs, for example as a result of handling in the factory, including, inspection, packaging, freight loading and transportation, storage, and logistical deployment. This will include impacts, accelerations, and a spectrum of vibrational inputs. The invention is designed to "reject" all such inputs and combinations of events, up to but not including the inputs of launch, by retaining the arming slider 20 in the safe position, and to "accept" the spectrum and sequence of inputs that occurs during launch by arming the weapon.

Figure 6:
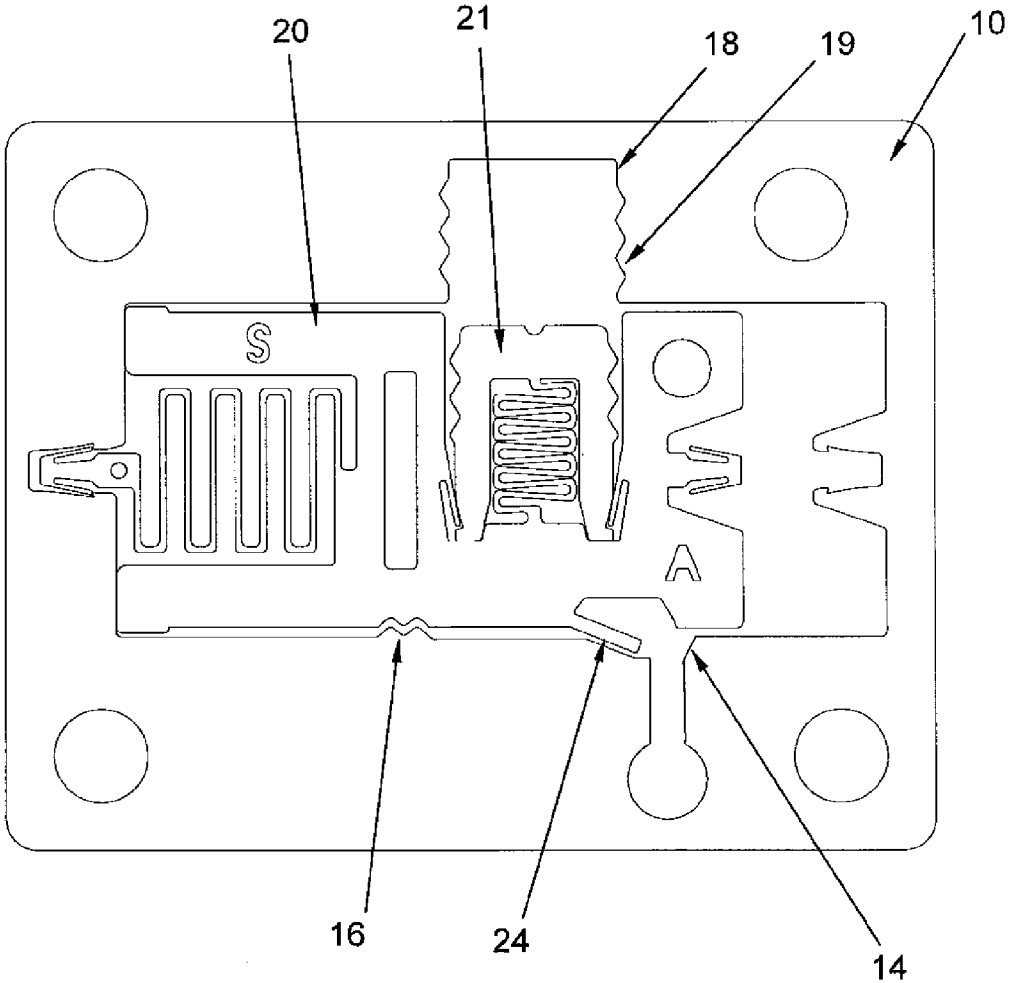
FIG. 6 is a plan view of the first embodiment of the MEMS S&A mechanism assembly, with the setback slider fully traveled and latched, and the second safety lock not yet enabled.

As described above, the S&A mechanical components of the first embodiment of the inventive device are disposed as shown in FIG. 1, with setback and arming mechanism 30, FIG. 5, inserted into frame 10. The setback slider 21 is disposed within setback slider travel slot 18 (pre-firing of the projectile, FIG. 1 and after firing of the projectile, FIG. 6), with its rack teeth 212, FIG. 5, loosely engaged with the frame's similar set of rack teeth, the setback slider zig-zag track 19, FIG. 6. The arming slider, as shown in FIGS. 1 and 6, is positioned at a first end of travel slot 11, with its bias spring 284 pre-tensioned by the insertion of the bias spring head 28 into arming slider bias spring head socket 17, where it latches. The arming slider latch 24 is designed as shown to extend across frame 10 as shown in FIG. 7 into the command lock release area (24, 15, 14), as will be explained, without blocking the nozzle 151.

The invention will reject vibrational inputs, so far as arming is concerned, because the arming slider is locked in two places by setback slider 21 (1st S&A interlock) and arming slider latch 24 with catch 14, and also because of the tensioned arming slider bias spring 284. The setback slider tends to reject vibrational input, so far as its releasing arming slider is concerned, because of the rack teeth 212 engagement with the frame rack teeth (zigzag slider track) 19, which will tend to dissipate vibrational energy, and also because of the compressive bias on setback slider spring 213, which will tend to keep the slider pressed against the frame at the top of its track 19.

The invention will also reject non-launch acceleration inputs such as impacts, so far as arming is concerned, again because the arming slider is locked in two places by setback slider 21 and arming slider latch 24 with catch 14 ($2^{nd}$ S&A interlock/safety lock), and also because of the tensioned arming slider bias spring 284 which will tend to restore a slightly displaced arming slider back to its safe position. The setback slider (1st S&A interlock) will also reject non-launch impacts or accelerations, so far as its releasing the arming slider is concerned, because of the rack teeth engagement with the frame as previously described, and as described in U.S. Pat. No. 5,705,767. The zig-zag engagement mechanical-inertial delay therein described provides a certain amount of safety in that it takes a minimum sustained inertial input such as launch to successfully draw the slider 21 all the way down to its latched position. If not fully drawn down into the latched position, the setback slider will be pushed back towards its original locking position by the compression forces in setback slider reset spring 213, which can push the slider back up at least partway through the rack engagement, thus re-setting it for the next inertial input.

If the setback slider 21 were missing in the assembly, the arming slider would remain in the safe position even after a lateral applied acceleration rightward toward arming, because of the subsequent engagement of slider latch 24 against catch 14. If the lateral acceleration were a short impact, bias spring 284 would tend to draw the arming slider back to the fully out of line position.

During a normal launch event, and while in the gun tube, the projectile body in which the invention operates undergoes large setback acceleration in which all components of the projectile are set back axially toward the rear due to launch acceleration. The projectile body also undergoes an angular acceleration as it is spun up by the rifling in the gun tube. Once the projectile leaves the gun tube, the setback acceleration ceases but the spin continues at a more or less constant rate. The sequential action of setback, tube exit and spin are the environments the invention exploits to validate launch and mechanically arm the weapon.

During a normal launch event, with the MEMS S&A oriented as indicated in FIG. 2 with the shown travel and acceleration direction 39 and preferred location of the weapon spin axis 38, the setback acceleration drives setback slider 21 downward through the zig-zag inertial delay engagement between setback slider rack teeth 212 and setback slider zig-zag rack 19 until it leaves the engagement and goes into free fall as the slider travels down setback slider travel slot 202 within the arming slider 20. With continued launch setback acceleration, slider 21 gathers speed, and then pushes past and deflects latch barbs 215 and stops at the end of the travel slot, in the configuration of FIG. 6. This completed action is referred to as removing the first safety lock or interlock, in the inventive device.

In the configuration of FIG. 6 the $1^{st}$ safety interlock is removed from the arming slider 20, but the arming slider cannot advance toward arming, even with the increasing rifling-induced spin rate about axis 38, because of the setback-induced engagement of arming slider rack teeth 26, FIG. 5, in travel slot rack teeth 16, FIG. 6. This rack-teeth engagement persists until tube exit (cessation of setback), preventing in-bore arming or enabling command second-lock release. After tube exit, the setback slider 20 is free to advance toward arming, propelled by spin-induced centrifugal acceleration. Note that in the configuration of FIG. 6 the command lock release function, as will be further described, is disabled because of the large gap (lack of a seal) between latch 24 and catch 14.

Upon tube exit, however, the forced engagement between rack 26 and rack 16 is discontinued, freeing the arming slider 20 from its $1^{st}$ position, as shown in FIG. 6, to advance toward arming, a second position as shown in FIG. 8, so long as ongoing centrifugal spin acceleration about axis of spin 38 can overcome the tension in arming slider bias spring 284. Significantly, aiding in overcoming the tension in arming slider bias spring 284 is effect of the additional mass added to the arming slider 20, by the incorporated mass of the set back slider 21 (nested therein). But this spin-induced motion advances the arming slider 20 only a short distance to where arming slider latch 24 engages with arming slider safety catch 14, FIG. 7.

This locking action of the arming slider latch 24 against the safety catch 14 comprises the second safety lock, or interlock, and prevents further advance of the arming slider. Upon removal of the $2^{nd}$ safety interlock, and with continued centrifugal spin acceleration, the arming slider will travel across and latch in the "armed" position, meaning that the transfer charge cavity 29 is aligned with firetrain bridge and spot charge 331 at one end and with receptor charge hole 333 at another end.

Motion of the arming slider to the second locked position "enables" the second safety lock's "command lock release" function, by forming a stop as shown in FIG. 7 between the arming slider latch 24 and the safety catch 14, and lining up the arming slider latch 24 with the nozzle 151. The output of the command initiator bridge and spot charge (henceforth command charge) 332 rapidly pressurizes gas expansion chamber 15 through command initiator hole 35 and forces gas through nozzle 151 to impinge energetically on arming slider safety catch 24, deforming it upward into a space provided by latch mechanism cavity 242, where it stays. The removal of this lock due to ducted command charge gas pressure then permits the arming slider to advance, provided that spin-induced acceleration is still operating, into the fully-armed and latched position the slider, FIG. 8. Normally, such removal of the second safety interlock will occur when a timeout or other criterion in the fuze circuit has determined that the munition has reached a "safe separation distance" from the weapon platform, and the fuze has sent a command lock release signal to the command charge.

In this invention, the fuze actually performs a command second-safety-interlock removal, and continued spin-induced centrifugal acceleration is required to actually move the arming slider to its armed position. So it is true of this invention that all arming energy comes from the launch environment, because if spin is not present, the tension of bias spring 284 will draw the arming slider back toward a safe position, and the slider will not advance to an armed state.

Figure 9:
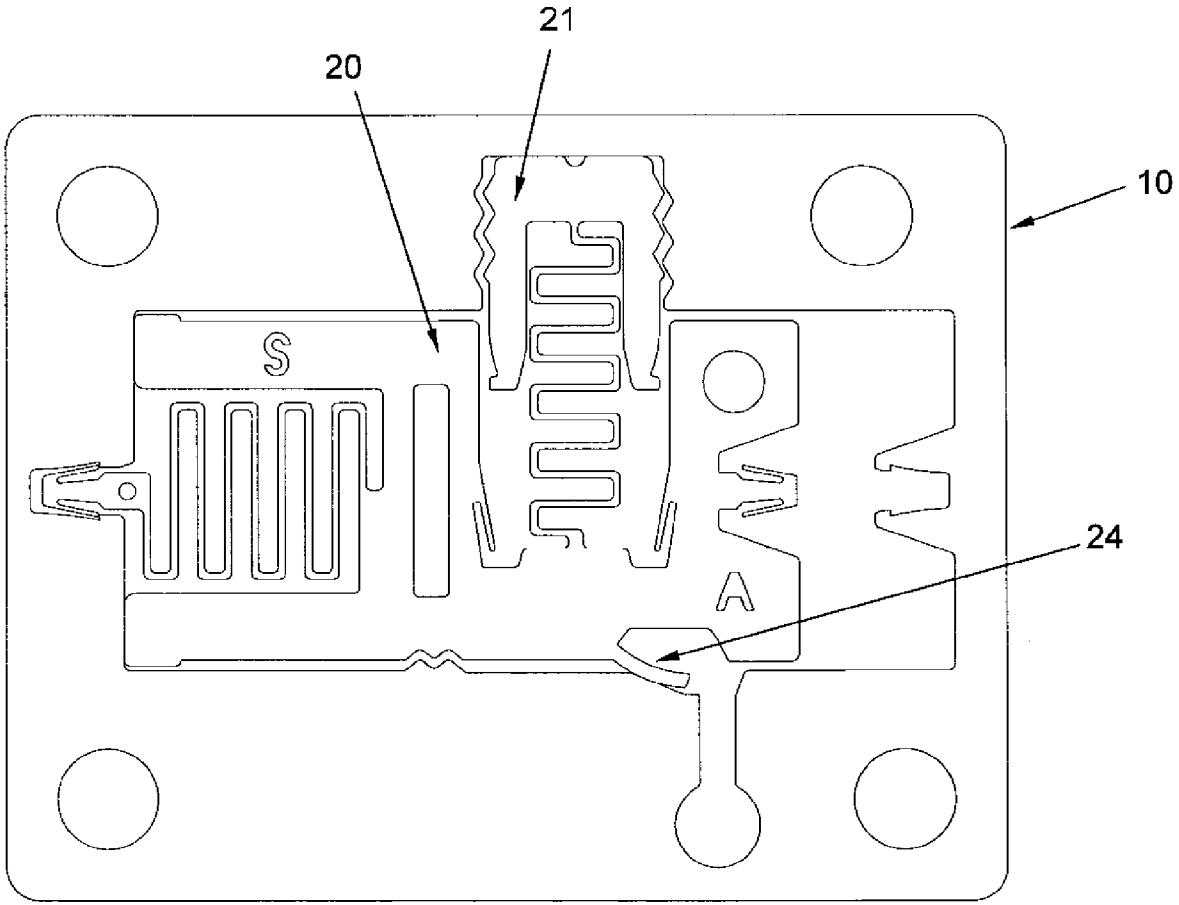
FIG. 9 is a plan view of the first embodiment of the MEMS S&A mechanism assembly, showing the positions of the setback slider, armed slider, and second safety lock, if the command initiator bridge and associated first spot charge fires before the arming slider reaches the enable position.

If the command charge is functioned prematurely, for example while the arming slider is in its safe position, so that there is a big gap between latch 26 and catch 14, the pressurized gases in chamber 15 and exiting through nozzle 151 pass rapidly through the open gap and pressurize latch mechanism cavity 242, driving and deforming the arming slider latch 24 downward against the frame, FIG. 9. In this configuration the deformed latch 24 will still engage with catch 14 if the slider subsequently tries to advance toward arming, permanently preventing movement of the arming slider to the armed position of FIG. 8.

Fuze safety is enhanced by the requirement that the arming environments must occur in a specific sequence or order: first setback acceleration exceeding a particular threshold and duration, then rightward lateral acceleration due to spin, with spin continuing for some time. If spin or a sideways acceleration occurs before setback, the arming slider cannot advance because the setback lock (setback slider engaging both frame and arming slider, FIG. 1) will prevent it. If the setback slider is missing, the arming slider will only advance to the second-safety-lock enabled position of FIG. 7 and be stopped there.

If an imposed acceleration is of insufficient duration and magnitude, the setback slider will not be induced to travel all the way down its inertial-delay zigzag track and then go beyond, against spring compression forces, and latch at the end of travel, and the arming slider will remain locked in a safe position by the continuing engagement of the setback slider 21 between the setback slot 18 and setback slider slot 202. If the command charge functions prematurely, the arming slider fails safe because second safety latch arm 24 is not removed. If the command charge does not function, the situation is the same. If the arming slider advances to an armed position, but latch head 22 fails to latch into socket 12, then once the munition spin rate reduces sufficiently or stops, pre-tensioned bias spring 284 will retract the arming slider to a safe position.

The operation of the second alternative embodiment of the subject invention, as disclosed in FIG. 10, and described above, is analogous in operation to that of the first embodiment of FIGS. 1-9; except that, the position of various features has been changed to accommodate a differently shaped transfer charge pocket.

The operation of the third alternative embodiment device of FIGS. 11-13 is analogous to that of the first embodiment of FIGS. 1-9, with the exception that the command initiator bridge and spot charge 332 output gas expansion serves to operate the bellows and rotate the rotor assembly 55, rather than to deflect the latch arm, of the first embodiment in the process of removing the second safety interlock on the respective arming sliders.

Fabrication and Assembly

The preferred method of construction is to fabricate setback and arming mechanism (SAM) 30 using MEMS wafer-based lithographic plating and molding technology to achieve a metal, preferably nickel, part with at least nearly vertical side walls, smooth planar features on top and bottom faces, and tight in-plane dimensional tolerances on the order of +5 microns. A suitable MEMS micro-fabrication technique to form such metal parts would be LIGA (Llthographie, Galvanoformung, Abformung). An alternative method to bring down cost would be to use lithographically based mold tools (LIGA tools) to press or form a number of additional molds, for example of plastic, that can in turn be plated into with metal to form precision parts. If desired, the arming slider 20 and the setback slider 21 can be fabricated separately and joined during assembly. See FIG. 4.

The frame 10 is preferably fabricated of metal and formed using similar lithographic-based plating and molding (LIGA) techniques. Alternative and more economic fabrication methods may include the use of LIGA or precision mold tools used as part of micro-die-casting, micro-injection molding or molding-and-sintering type technologies in structural materials such as steel, aluminum or tungsten. Fabricating the frame and the SAM of the same material reduces or eliminates changes to the working clearances due to differential thermal expansion and corrosion due to dissimilar metals.

The cover assembly 31 is preferably fabricated from a suitable non-brittle material that provides structural integrity and adequate explosive confinement for input explosive column 34 and command charge gases in hole 35, such as aluminum, steel, or structural plastic. It also provides a planar ceiling or cover to allow motion of the moving parts of the MEMS S&A assembly, the SAM 30, while constraining them in-plane with the frame. There is preferably a working clearance inside the assembly between the cover and the top of the SAM and between the substrate and the bottom of the SAM, to allow motion of the sliders.

The preferred method of construction assures good working clearance also between the working mechanism and features on the frame, such as the setback slider zigzag track 19 and the arming slider travel slot 11, on the order of 5 to 30 microns, but not so much clearance that the zig-zag track does not engage with the setback slider rack teeth 212.

The base 32 is preferably fabricated in metal such as aluminum or steel or possibly zinc, or suitable alloys not including copper that provide adequate explosive confinement for the output charge in cavity 334 as well as structural rigidity for the MEMS S&A assembly 9. If pins 8 are used to fasten the assembly, they are preferably welded to the base 32.

Initiator board 33 and edge card connector 336 is preferably fabricated of typical multi-layer circuit board materials.

Another alternative MEMS fabrication methodology utilizes new technologies, for example multi-pass precision metal stamping or bulk metallic glass forming, that can achieve the same results and dimensional resolution as the preferred LIGA-based methods produce and also achieve the intended results of the invention, including mechanism function, firetrain implementation, fuze circuit interface, etc. For example, the cover assembly 31 and output explosive assembly 32 could be fabricated using micro-mold and sinter or micro-die-casting type technologies. The frame 100 and substrate 111 could be fabricated as one homogeneous part using one of the above technologies as well.

Alternatively, the subject inventive device can be implemented at an arbitrary scale, for example at a scale that is larger than the typical feature sizes for micro-scale, lithographic fabrication techniques such as LIGA. Such a device would have all the same function and features, except that working clearances might be significantly larger or different than the microns or tens-of-microns scale of MEMS fabrication, allowing possibly for manufacture using "macro scale" or traditional technology to make the parts, such as stamping, die casting, molding and sintering, etc.

What is claimed is:

1. A MEMS safety and arming device to arm a projectile fired from a rifled launch tube, having a series of safety interlocks responsive to the setback acceleration of firing, spin after firing, and to an arming command signal from a fuze circuit, the device comprising:

a substrate;

a frame, including an elongated arming slider travel slot, disposed on the substrate;

said arming slider travel slot being positioned generally perpendicular to the direction of acceleration of the projectile and aligned substantively along the longitudinal centerline of said frame;

an arming slider disposed adjacent a first end of the arming slider travel slot for movement linearly therethrough in an arming direction, to a second end thereof, whereby the arming slider is in an arming position, the linear movement of the arming slider being in response to said spin after firing;

a arming slider spring having a first end attached to a first arming slider latch head, which is secured in an arming slider bias spring head socket in the frame at the first end of the arming slider travel slot;

the arming slider spring having a second end attached to the arming slider on an end of the arming slider in the direction opposite that of the arming direction;

the arming slider further including, on an end of the arming slider in the arming direction, a second arming slider latch head for locking the arming slider after linear movement of the arming slider by inserting the second arming slider latch head in an arming slider latch socket in the frame at the second end of the arming slider travel slot;

a setback slider disposed in the frame, in a setback slider travel slot extending perpendicularly from within the arming slider, through the arming slider travel slot toward the edge of the frame in the direction of acceleration of the projectile, the setback slider travel slot being located eccentrically within the arming slider toward the arming direction;

the setback slider moves linearly within the setback slider travel slot in response to setback acceleration, from a first position, pre-acceleration position, where the setback slider is partially within the arming slider and partially extending therefrom into the frame, to a second, post-acceleration position where the setback slider is nested within the arming slider, enabling the arming slider to move laterally towards its armed position;

the setback slider having a first end in the direction of setback acceleration, to which end is attached a first end of a setback slider spring, which setback slider spring has a second end, which second end is attached to the arming slider, wherein motion of the setback slider in response to setback acceleration compresses the setback slider spring;

a flexible arming slider latch, formed as an arm extending from a corner along the edge of the arming slider opposite the direction of acceleration, which corner is formed by a lateral depression in the arming slider, the arm extending obliquely in the arming direction of the arming slider and into the first side of a duct opening, which opening opens into the arming slider travel slot; such that, when the arming slider moves in the arming direction, the arming slider latch will transit the duct opening and impacting upon a safety catch, located in the frame on the second side of the duct opening, preventing any further motion of the arming slider in the arming direction; and a spot charge, electrically stimulated by an arming command signal from the fuze circuit, which charge generates gases that flow into the duct and expand, thereby forcing the arming slider latch into the depression within the arming slider, freeing the arming slider latch from contact with the safety catch, allowing the arming slider to continue to move into its armed position.

2. The device of claim 1, wherein the arming slider includes zig-zag racks that cooperate with zig-zag racks in the frame to delay movement of the arming slider.

3. The device of claim 1, wherein the setback slider includes zig-zag racks that cooperate with zig-zag racks in the frame to delay movement of the setback slider.

4. The device of claim 1, wherein the setback and arming slider are a single, monolithic assembly.

5. The device of claim 1, wherein the frame is in the third of four assembly layers, wherein the first layer is an explosive initiator assembly, the second layer is a cover assembly and the fourth layer is an output base.

6. The device of claim 5, wherein the explosive initiator assembly contains a command initiation bridge circuit, to trigger a spot charge therein, initiated by the arming command signal from the fuze circuit, and also contains a firetrain initiation bridge circuit, to trigger the firetrain that will discharge the projectile.

7. The device of claim 5, wherein the cover assembly contains a command hole to transmit the arming command that allows the gases generated to flow into and through the duct and to force the arming slider latch into the depression within the arming slider, freeing the arming slider latch from contact with the safety catch, allowing the arming slider to continue to move into its armed position.

8. The device of claim 5, wherein the output base layer contains an output charge which when detonated will detonate an explosive acceptor change within the projectile to ignite the warhead of the projectile.

* * * * *